US007621616B2

(12) United States Patent
Mitani et al.

(10) Patent No.: US 7,621,616 B2
(45) Date of Patent: Nov. 24, 2009

(54) INK JET RECORDING APPARATUS AND METHOD AND PROGRAM FOR CHECKING NOZZLES THEREOF

(75) Inventors: Yasutaka Mitani, Yokohama (JP); Tadashi Yamamoto, Yokohama (JP); Takuya Tsujimoto, Kawasaki (JP); Yasuhiro Unosawa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/299,635

(22) Filed: Dec. 12, 2005

(65) Prior Publication Data

US 2006/0125869 A1 Jun. 15, 2006

(30) Foreign Application Priority Data

Dec. 14, 2004 (JP) ..... 2004-360656

(51) Int. Cl.
*B41J 29/393* (2006.01)

(52) U.S. Cl. ..... 347/19; 347/67; 347/81; 347/54; 347/9

(58) Field of Classification Search ..... 347/9, 347/19, 67, 54, 81
See application file for complete search history.

(56) References Cited

U.S. PATENT DOCUMENTS 6,305,777 B1 * 10/2001 Lee ..... 347/19
6,726,318 B2 * 4/2004 Arakawa ..... 347/106
2002/0186268 A1 * 12/2002 Endo et al. ..... 347/19
2005/0078138 A1 * 4/2005 Koyama ..... 347/19

FOREIGN PATENT DOCUMENTS

JP 11-192709 * 7/1999
JP 11192709 A * 7/1999
JP 2003-276171 9/2003

* cited by examiner

*Primary Examiner*—Matthew Luu
*Assistant Examiner*—Henok Legesse
(74) *Attorney, Agent, or Firm*—Canon USA Inc IP Div

(57) ABSTRACT

A recording head includes an ink-discharging surface and nozzles. The ink-discharging surface is provided with ink-discharging ports of the nozzles. A light-emitting element and a light-receiving element are disposed opposite each other close to the ink-discharging surface. The light-receiving element outputs a detection signal. A reflector is provided on the ink-discharging surface and reflects light emitted from the light-emitting element toward the light-receiving element. One of the nozzles is driven and whether the nozzle discharges an ink drop is checked on the basis of change in the detection signal due to interception of the reflected light by the ink drop. If the nozzle discharges an ink drop, then whether the nozzle discharges the ink drop in an appropriate direction is checked on the basis of change in the detection signal due to interception of the direct light by the ink drop.

3 Claims, 6 Drawing Sheets

CONDITION OF NOZZLE

| | DS > V1 | DS ≤ V1 |
|---|---|---|
| DS > V2 | NON-DISCHARGE | OBLIQUE DISCHARGE |
| DS ≤ V2 | NON-DISCHARGE | NORMAL DISCHARGE |

DS: DETECTION SIGNAL
V1, V2: VOLTAGE THRESHOLD

INK JET RECORDING APPARATUS AND METHOD AND PROGRAM FOR CHECKING NOZZLES THEREOF

BACKGROUND OF THE INVENTION

1. Field of the Invention

The present invention relates to an ink jet recording apparatus that records an image with a recording head discharging ink drops from nozzles, and a method and a program for checking the condition of the nozzles.

2. Description of the Related Art

In ink jet recording apparatuses, when the ink jet recording apparatus records an image received from, for example, a host computer (hereinafter referred to as "received image"), a state in which some nozzles of the recording head do not discharge ink drops (hereinafter referred to as "non-discharge") can occur. This non-discharge is caused by adhesion of ink in the nozzles, clogging in the nozzles due to dust or bubbles, or problems with heaters in the nozzles. In addition, a state in which some nozzles discharge ink drops in inappropriate directions (hereinafter referred to as "oblique discharge") can occur. This oblique discharge is caused by ink or dust adhering around the discharging ports of the nozzles, or lack of discharging power due to deterioration of heaters in the nozzles. Moreover, a state in which initial discharge of some nozzles is defective and discharging velocity is inappropriately low (hereinafter referred to as "defective initial discharge") can occur. This defective initial discharge is caused by defective transfer of discharging energy due to deterioration of the nozzles.

If the non-discharge, oblique discharge, or defective initial discharge occurs, the recording apparatus cannot record an image accurately. Therefore, before performing recording of the received image, the recording apparatus checks the nozzles, that is to say, checks whether normal discharge, non-discharge, oblique discharge, or defective initial discharge will occur. If non-discharge, oblique discharge, or defective initial discharge is detected, an appropriate maintenance processing is carried out. In this way, the recording apparatus can always record an image accurately.

In the process flow for recording a received image, first, an initial processing is carried out and then the nozzles are checked. If no defective nozzles are detected, a recording sheet is fed, and the received image is recorded on it. Thereafter, the recording sheet is ejected, and image recording is completed. If any non-discharge, oblique-discharge, or defective-initial-discharge nozzles are detected, purgative processing (e.g., sucking ink out of the nozzles) or maintenance processing (e.g., error processing) is carried out.

For example, Japanese Patent Laid-Open No. 2003-276171 discusses a system for checking nozzles. The system includes a plurality of detecting units. Each detecting unit includes a light-emitting device and a light-receiving device. The light-emitting device emits an optical beam. The light-receiving device receives the optical beam. The plurality of detecting units are disposed so that an ink drop discharged from a nozzle of a recording head crosses and intercepts the optical beams. The plurality of detecting units are arranged parallel to the direction in which an ink drop is discharged. This system can detect not only non-discharge but also inappropriate discharge. That is to say, the system has a plurality of pairs of light-emitting/receiving devices that are disposed just below a row of nozzles and arranged vertically and parallel to each other. On the basis of whether a discharged ink drop intercepts the optical beams, the system can detect non-discharge and inappropriate discharge (in direction or velocity).

However, since the above system needs at least two pairs of light-emitting/receiving devices, the above system is expensive and occupies much space. In addition, the first pair of light-emitting/receiving devices nearest to the ink-discharging surface of the recording head, where the discharging ports of the nozzles are provided, need to be disposed at a distance from the ink-discharging surface so that the optical beam between the light-emitting/receiving devices does not come into contact with the ink-discharging surface. Therefore, in the case of oblique discharge, if the deviation angle is large, the discharged ink drop does not intercept the first optical beam, and the system mistakes the oblique discharge as non-discharge.

SUMMARY OF THE INVENTION

The present invention is directed to an ink jet recording apparatus that can check the operation of nozzles of a recording head with an inexpensive and space-saving system.

In an aspect of the present invention, an ink jet recording apparatus includes a recording head, a light-emitting element, a light-receiving element, and a reflector. The recording head includes an ink-discharging surface and nozzles configured to discharge ink drops to record an image. The ink-discharging surface is provided with ink-discharging ports of the nozzles. The light-emitting element and the light-receiving element are disposed opposing each other and substantially close to the ink-discharging surface. The light-receiving element is operable to output a detection signal. The reflector is provided on the ink-discharging surface and reflects light emitted from the light-emitting element toward the light-receiving element. The light-emitting element, the light-receiving element, and the reflector are disposed so that an ink drop normally discharged from one of the nozzles placed at a predetermined position intercepts light reflected by the reflector and then intercepts direct light transmitted from the light-emitting element to the light-receiving element. The ink jet recording apparatus drives the nozzle to check whether the nozzle discharges an ink drop on the basis of change in the detection signal due to interception of the reflected light. If the nozzle discharges an ink drop, then the ink jet recording apparatus checks whether the nozzle discharges the ink drop in an appropriate direction on the basis of change in the detection signal due to interception of the direct light.

Further features of the present invention will become apparent from the following description of exemplary embodiments (with reference to the attached drawings).

DESCRIPTION OF THE EMBODIMENTS

Embodiments of the present invention will now be described with reference to the attached drawings. Here, the embodiments concern a bubble jet (registered trade name) printer as an example of an ink jet recording apparatus. The bubble jet printer is a serial printer and performs color recording.

Embodiments

Figure 1A:
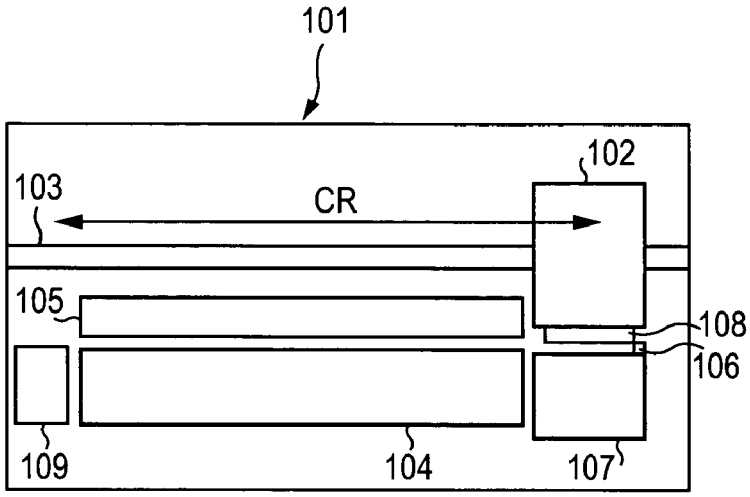
FIG. 1A is a front view schematically showing the structure of an ink jet printer according to an embodiment of the present invention.
Figure 1B:
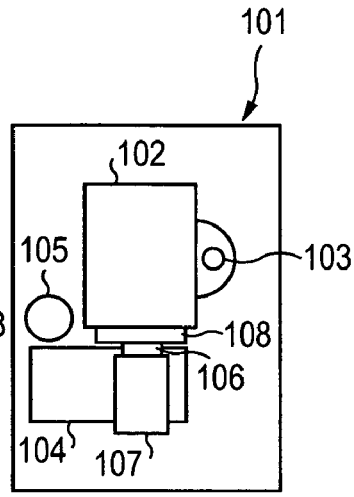
FIG. 1B is a side view of the printer.

FIGS. 1A and 1B show the structure of an ink jet printer (hereinafter referred to as "printer") 101. FIG. 1A shows a front view. FIG. 1B shows a side view.

A recording head 108 has an ink-discharging surface where the ink-discharging ports of a plurality of nozzles are provided. The recording head 108 is attached to a carriage 102 such that the ink-discharging surface faces downward. The carriage 102 can slide along a guide shaft 103. The carriage 102 is driven by a motor (not shown), thereby moving in a reciprocating manner in the direction of arrow CR (main scanning direction). A recording medium (recording sheet, not shown) is conveyed between a platen 104 and a paper-feeding roller 105 in a direction perpendicular to the direction CR (sub-scanning direction). The recording head 108 moves together with the carriage 102. The nozzles of the recording head 108 sequentially discharge ink drops onto the recording medium so as to print an image on the recording medium.

A purging unit 107 is provided in a home position at the extreme right in FIG. 1A of the moving range of the carriage 102. The purging unit 107 has a wiper 106. If the recording head 108 does not discharge ink correctly, the purging unit 107 carries out an operation to purge the discharge ports. For example, the purging unit 107 wipes away the dust on the ink-discharging surface, or sucks ink out of the nozzles.

A nozzle checking unit 109 is provided in a non-printing area at the extreme left in FIG. 1A of the moving range of the carriage 102. The nozzle checking unit 109 checks the condition of the nozzles of the recording head 108 (whether normal discharge, non-discharge, oblique discharge, or defective initial discharge occurs).

Figure 2:
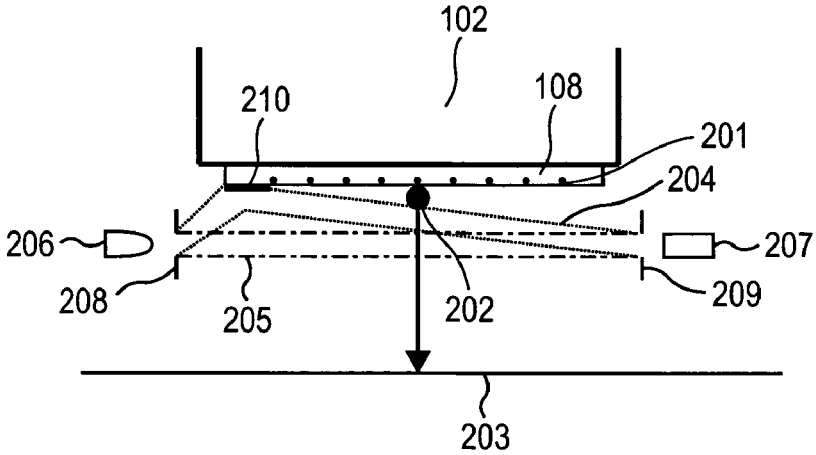
FIG. 2 is an explanatory view schematically showing the configuration concerning checking the nozzles of the printer.

FIG. 2 illustrates the structure of the nozzle checking unit 109 and how the nozzle checking unit 109 checks the condition of the nozzles (whether discharge or non-discharge occurs). FIG. 2 is a side view of the recording head 108 and the vicinity of the recording head 108 viewed from a moving direction of the carriage 102. The ink-discharging surface is the lower surface in FIG. 2 of the recording head 108. On the ink-discharging surface, a plurality of ink-discharging nozzles 201 (technically, ink-discharging ports of the nozzles) are arranged in four straight lines in the sub-scanning direction. The four rows of nozzles correspond to four color inks (cyan, magenta, yellow, and black, see FIG. 5B). Four tanks of color inks (not shown) are attached to the recording head 108. The inks are supplied to the corresponding rows of nozzles 201 through ink supply paths (not shown) in the recording head 108.

When the printer receives a discharge command from a host computer (not shown), a driving voltage is applied to a heater (not shown) in the corresponding nozzle 201. The heater heats the ink so as to form bubbles. The pressure of the bubble discharges an ink drop 202 from the discharging port of the nozzle 201. In this way, the nozzles 201 discharge an ink drop 202 one after another. The ink drops 202 hit and are absorbed by an ink absorber 203 provided in the nozzle checking unit 109 shown in FIG. 1A.

The nozzle checking unit 109 includes a light-emitting element 206 and a light-receiving element 207. The light-emitting element 206 and the light-receiving element 207 are disposed above the ink absorber 203 and just below the ink-discharging surface of the recording head 108. The light-emitting element 206 and the light-receiving element 207 are disposed across the array of nozzles 201 from each other. For example, a high-directionality infrared LED, another type of LED, or a laser is used as the light-emitting element 206. A photodiode or a phototransistor is used as the light-receiving element 207. Diaphragms 208 and 209 are provided just in front of each of the light-emitting element 206 and the light-receiving element 207, respectively. Each diaphragm has a square aperture with an area of about 2 mm×2 mm in the center. A reflector 210 is provided on one side of the ink-discharging surface of the recording head 108. The reflector 210 is water-repellent so as not to be soiled with ink.

When the light-emitting element 206 is turned on, two light beams are formed from the light-emitting element 206 to the light-receiving element 207 through the diaphragms 208 and 209, that is to say, a beam of direct light 205 and a beam of light 204 reflected by the reflector 210 (hereinafter referred to as "reflected light"). The light-emitting element 206, the light-receiving element 207, and the diaphragms 208 and 209 are arranged such that the beam of direct light 205 is parallel to the rows of nozzles 201 when the rows of nozzles 201 are just above the beam of direct light 205. The beam of reflected light 204 is nearer to the ink-discharging surface of the recording head 108 than the beam of direct light 205.

When the nozzles are checked, a voltage of, for example, a few volts is applied to the light-emitting element 206 so that the light-emitting element 206 emits light. The reflected light 204 and the direct light 205 coming from the light-emitting element 206 are detected by the light-receiving element 207. On the basis of the detection signal, the condition of the nozzles is checked. The diaphragms 208 and 209 adjust the quantity of the reflected light 204 and the direct light 205 so as to improve the signal-to-noise ratio.

The recording head 108 moves to place the nozzles 201 just above the reflected light 204 and the direct light 205. When an ink drop 202 is normally discharged from a nozzle 201, the ink drop 202 first intercepts the reflected light 204 and then intercepts the direct light 205, owing to the positional relationship among the light-emitting element 206, the light-receiving element 207, the diaphragms 208 and 209, and the reflector 210. Thereafter, the ink drop 202 hits and is absorbed by the ink absorber 203. The light-receiving element 207 first reads the change in the quantity of the reflected light 204 when the ink drop 202 intercepts the reflected light 204, and converts the change into an electrical signal. Next, the light-receiving element 207 reads the change in the quantity of the direct light 205 when the ink drop 202 intercepts the direct light 205, and converts the change into an electrical signal. In the checking of the operation of the nozzles, each nozzle 201 discharges ink only once.

The detection range of the oblique discharge (to be hereinafter described) can be changed by changing the position of the direct light 205 or the size of the aperture of the diaphragm 209. The position of the direct light 205 can be changed by changing the positions of the light-emitting element 206 and the light-receiving element 207.

Figure 3:
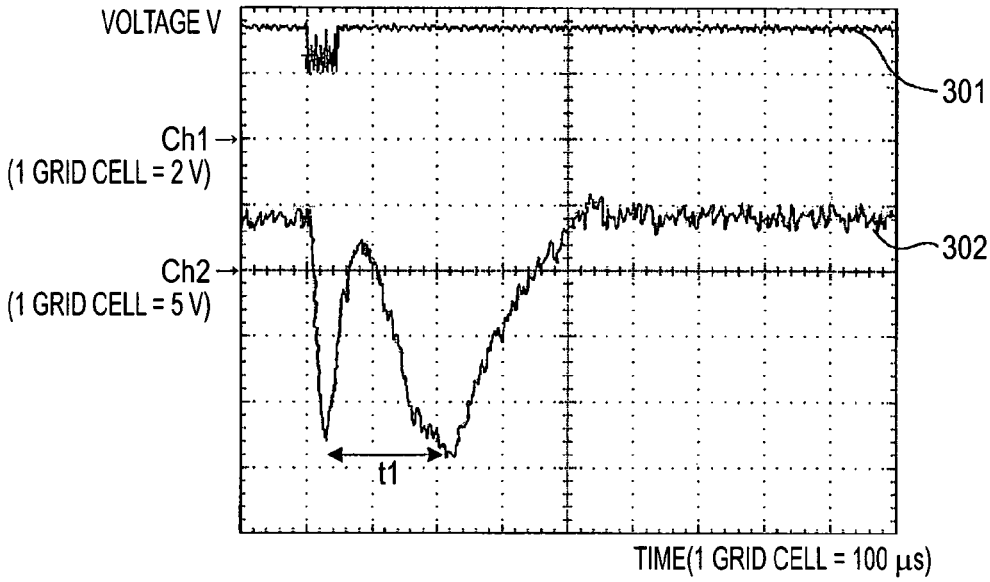
FIG. 3 is a signal waveform diagram showing the waveform of the detection signal output from the light-receiving element in the case where an ink drop is normally discharged from a nozzle of the recording head of the printer.

FIG. 3 shows the detection signal output from the light-receiving element 207 in the case where discharge is carried out normally when the operation of a nozzle is checked. The vertical axis shows the voltage of signals. The horizontal axis shows the time (the width of one grid cell corresponds to 100 μs). The driving signal 301 in FIG. 3 is for making the nozzle start to discharge ink. With regard to the driving signal 301, the voltage indicated by arrow Ch1 is 0 V, and the height of one grid cell corresponds to 2 V. The driving signal 301 is normally fixed at 3.3 V. When the printer receives a discharge command, the driving signal 301 drops to about 2 V, and the discharge starts.

The light-receiving element 207 outputs an electrical signal showing the quantity of light incident on the light-receiving element 207. The detection signal 302 is an amplification of the output signal. With regard to the detection signal 302, the voltage indicated by arrow Ch2 is 0 V, and the height of one grid cell corresponds to 5 V. When the quantity of the incident light drops, the voltage of the detection signal 302 drops. When the discharge starts, the detection signal 302 first drops to about −12.5 V. This first change part shows the interception of the reflected light 204 by the discharged ink drop 202. Next, the detection signal 302 rises close to 0 V, and then drops again to about −14 V. This second change part shows the interception of the direct light 205 by the ink drop 202.

Figure 4:
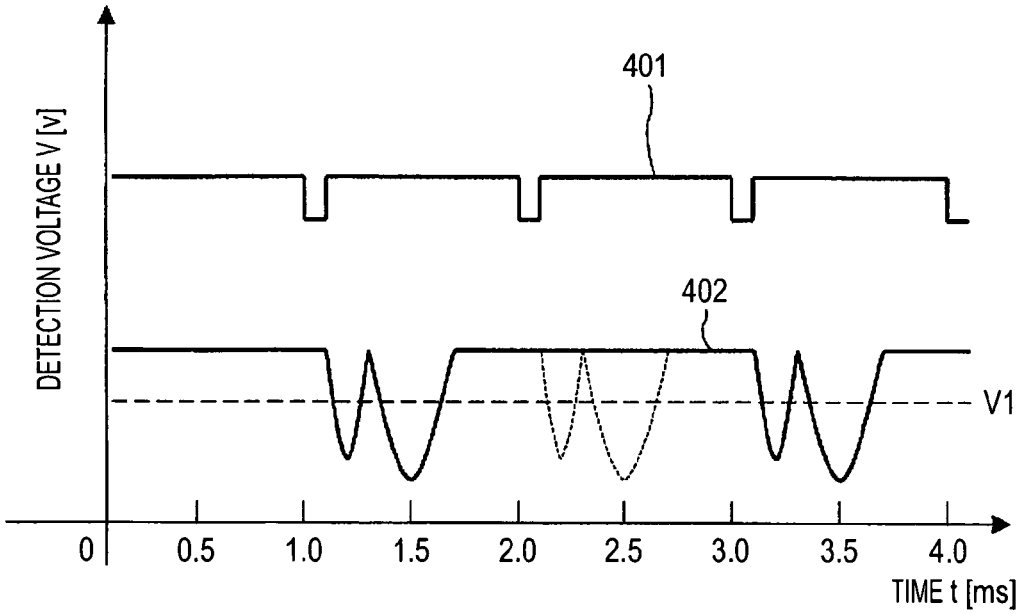
FIG. 4 is a signal waveform diagram showing the waveform of the detection signal in the case where one of the nozzles is a non-discharge nozzle.

FIG. 4 shows the driving signal 401 and the detection signal 402 output from the light-receiving element 207 in the case where nozzles 201 in a nozzle row are driven sequentially at intervals of 1 ms. In this case, the first and third nozzles discharge ink drops normally. Correspondingly, the detection signal 402 changes (drops), as explained in FIG. 3, just after the first and third rises in the driving signal 401. In contrast, the second nozzle does not discharge an ink drop. Normally, the detection signal 402 must change as shown by the dashed line. However, as shown by the solid line, the detection signal 402 does not change.

In the present embodiment, as shown by the dashed line in FIG. 4, a first voltage threshold V1 is set for the detection signal 402 in order to determine whether discharge or non-discharge occurs. The periods just after the rises in the driving signal 401 and in which the above-described first changes in the detection signal 402 must occur if discharges are normal, will be hereinafter referred to as "first detection periods." In each first detection period, whether the first change in the detection signal 402 occurs or not is determined on the basis of whether the voltage value of the detection signal 402 is lower than or equal to the voltage threshold V1 or not. The first change occurs due to interception of the reflected light 204 by a discharged ink drop. Therefore, whether the first change occurs or not, that is to say, corresponds to whether the reflected light 204 is intercepted or not. In this way, whether each nozzle 201 discharges an ink drop or not is determined. When the detection signal 402 is lower than or equal to the voltage threshold V1, it is determined that the reflected light 204 has been intercepted, and therefore an ink drop has been discharged. If not so, it is determined that no ink drop has been discharged. In the case where no ink drop has been discharged, the corresponding nozzle is identified as a non-discharge nozzle, and the data of the nozzle is stored in the RAM of the memory 905 (to be hereinafter described, see FIG. 9) of the printer. In this way, whether each nozzle 201 discharges an ink drop or not is checked.

Figure 5A:
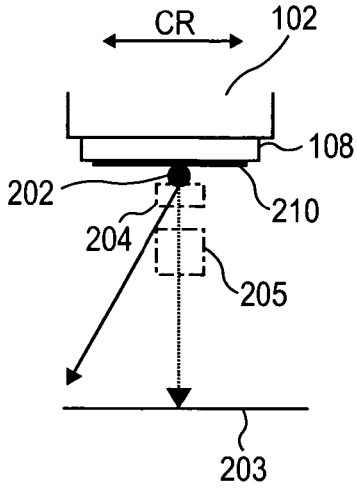
FIG. 5A is an explanatory view of the recording head and the vicinity of the recording head when the nozzles are checked as viewed from the front of the carriage.
Figure 5B:
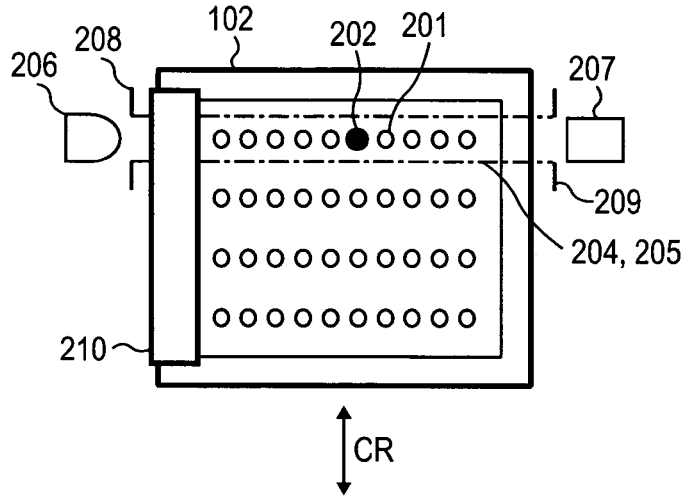
FIG. 5B is an explanatory view of the ink-discharging surface of the recording head and the vicinity of the ink-discharging surface when the nozzles are checked.

Next, the method for detecting oblique-discharge nozzles will be described. FIG. 5A is an explanatory view of the recording head 108 and the vicinity of the recording head 108 when the operation of the nozzles is checked as viewed from the front of the carriage 102. FIG. 5B is an explanatory view of the ink-discharging surface of the recording head 108 and the vicinity of the ink-discharging surface when the operation of the nozzles is checked. As shown in FIG. 5B, in the ink-discharging surface of the recording head 108, a plurality of nozzles 201 (technically, ink-discharging ports of the nozzles) are arranged in four straight lines in a direction perpendicular to the moving direction of the carriage 102 shown by arrow CR. The four rows of nozzles correspond to four color inks (cyan, magenta, yellow, and black) and are arranged in the moving direction of the carriage 102 at regular intervals.

In the case of a normal nozzle 201, an ink drop 202 is discharged in a direction perpendicular to the ink-discharging surface of the recording head 108 as shown by the dashed arrow in FIG. 5A. The ink drop 202 intercepts the reflected light 204, and then intercepts the direct light 205. In contrast, in the case of an oblique-discharge nozzle 201, an ink drop 202 is discharged in an inappropriate direction, that is to say, in a direction angled with respect to the direction perpendicular to the ink-discharging surface, as shown by the solid arrow in FIG. 5A. The ink drop 202 intercepts the reflected light 204, but does not intercept or partially intercepts the direct light 205.

Figure 6:
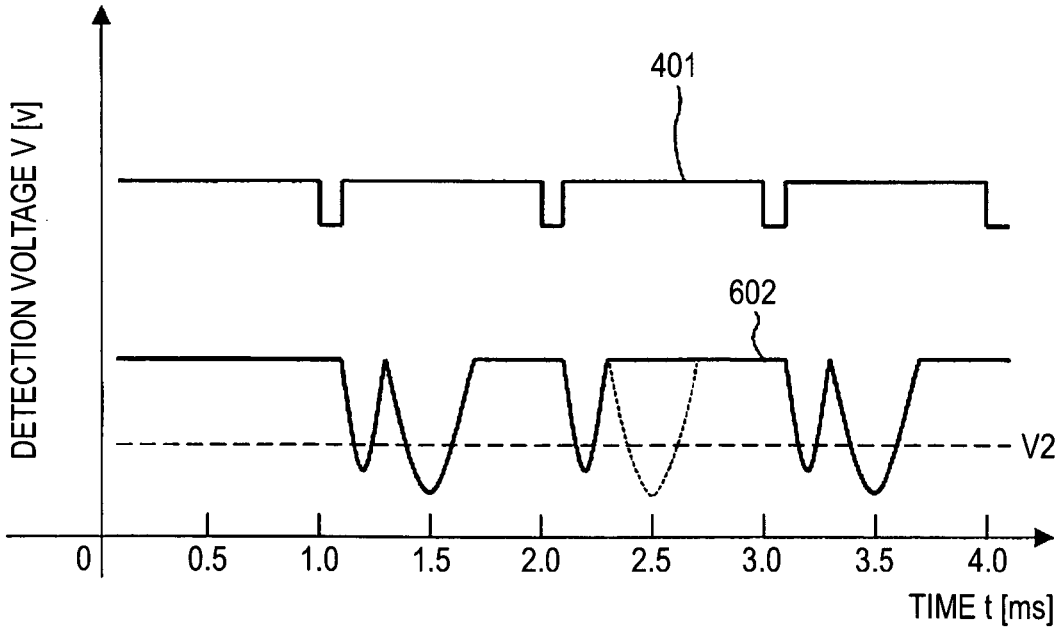
FIG. 6 is a signal waveform diagram showing the waveform of the detection signal in the case where one of the nozzles is an oblique-discharge nozzle.

FIG. 6 shows the waveform of the detection signal 602 output from the light-receiving element 207 in the case where one of the nozzles discharges an ink drop obliquely, in the same form as FIG. 4, together with the driving signal 401 for driving nozzles. In this case, the first and third nozzles discharge ink drops normally. In contrast, the second nozzle discharges an ink drop obliquely. Normally, the detection signal 602 must change as shown by the dashed line. However, as shown by the solid line, the detection signal 602 does not change. Or the amount of change is small as compared with normal discharge. The larger the deviation angle of the discharging direction, the smaller the quantity of the direct light 205 intercepted by the ink drop. Therefore, the larger the deviation angle of the discharging direction, the smaller the change in the detection signal 602.

In the present embodiment, as shown by the dashed line in FIG. 6, a second voltage threshold V2 is set for the detection signal 602 in order to determine whether the discharge is oblique or not. The periods after the rises in the driving signal 401 and in which the above-described second changes in the detection signal 602 must occur if discharges are normal, will be hereinafter referred to as "second detection periods." In each second detection period, whether the second change in the detection signal 602 occurs or not is determined on the basis of whether the voltage value of the detection signal 602 is lower than or equal to the voltage threshold V2 or not. The second change occurs due to interception of the direct light 205 by a discharged ink drop. Therefore, whether the second change occurs or not, that is to say, corresponds to whether the direct light 205 is intercepted or not. In this way, whether each nozzle 201 discharges an ink drop normally or obliquely is determined.

The determination of whether normal discharge or oblique discharge occurs depends on the result of the above-described detection of whether discharge or non-discharge occurs. Not only in the case of oblique discharge but also in the case of non-discharge, the direct light 205 is not intercepted. Therefore, it cannot be determined whether a nozzle is an oblique-discharge nozzle on the basis of whether the direct light 205 is intercepted or not. Only in the case where a discharge is detected on the basis of the interception of the reflected light 204, can it be determined whether a nozzle is an oblique-discharge nozzle on the basis of whether the direct light 205 is intercepted or not.

Incidentally, in the case of defective initial discharge (to be hereinafter described), in the detection signal output from the light-receiving element 207, the occurrence of the above-described first and second changes, especially of the second change, is late. Therefore, the above-described first and second detection periods need to be sufficiently long.

Figures 7, 8:
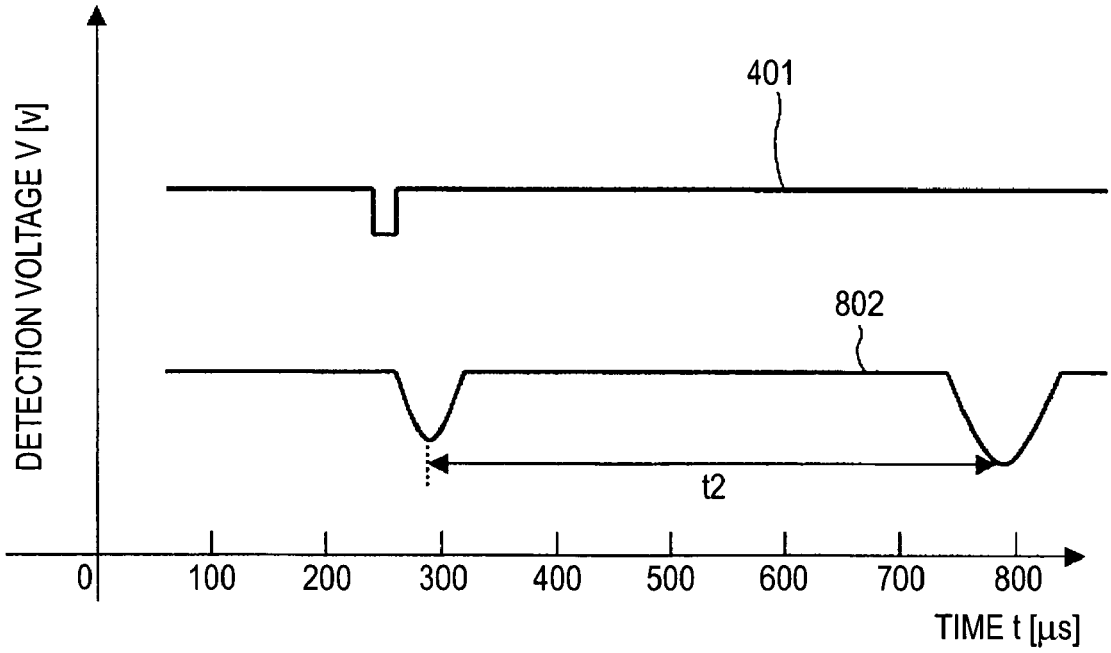
FIG. 7 is a table used for determining the nozzle condition by comparing the voltage of the detection signal output from the light-receiving element with the voltage thresholds V1 and V2.
FIG. 8 is a signal waveform diagram showing the waveform of the detection signal in the case of the defective initial discharge.

The above description is tabulated in FIG. 7. FIG. 7 shows a table used for determining the nozzle condition by comparing the voltages of the detection signal output from the light-receiving element 207 in the first and second detection periods, with the voltage thresholds V1 and V2, respectively. When the voltage of the detection signal is higher than the threshold V1 throughout the first detection period, the reflected light 204 has not been intercepted. Therefore, the nozzle is identified as a non-discharge nozzle, regardless of whether the voltage of the detection signal in the second detection period is higher than the second threshold V2 or not. When the voltage of the detection signal in the first detection period is lower than or equal to the threshold V1 and the voltage of the detection signal is higher than the second threshold V2 throughout the second detection period, the nozzle is identified as an oblique-discharge nozzle. When the voltage of the detection signal in the first detection period is lower than or equal to the threshold V1 and the voltage of the detection signal in the second detection period is lower than or equal to the second threshold V2, the nozzle is identified as a normal-discharge nozzle. However, the "normal discharge" here is not always completely normal discharge because discharging velocity is not taken into consideration. The "normal discharge" here can include defective initial discharge in which discharging velocity is inappropriately low.

Next, the method for detecting the defective initial discharge will be described. The ink drop discharged from a defective-initial-discharge nozzle is not provided with a sufficient discharge energy, and therefore the velocity of the ink drop is lower than that of an ink drop discharged normally. The velocity of an ink drop discharged normally is in the range of 10 to 20 m/s. In contrast, in the case of initial defective discharge, the velocity is lower than a few meters per second. That is to say, a defective-initial-discharge nozzle can be detected by measuring the velocity of a discharged ink drop. In order to measure the discharging velocity, the time from the interception of the reflected light 204 by the ink drop 202 until the interception of the direct light 205 by the ink drop 202 (hereinafter referred to as "interception time") is measured. This interception time can be said to be the time showing the velocity of the ink drop 202.

In the case of normal discharge shown in FIG. 3, the interception time t1 (which corresponds to the time from the bottom of the first valley until the bottom of the second valley in the detection signal 302) is, for example, 160 μs. In contrast, in the case of defective initial discharge shown in FIG. 8, the interception time t2 in the detection signal 802 is, for example, 500 μs. When the distance between the reflected light 204 and the direct light 205 is about 2 mm, the discharging velocity for the normal discharge is about 12.5 m/s, and the discharging velocity for the defective initial discharge is about 4 m/s.

In the present embodiment, a time threshold ts is set for the interception time (discharging velocity). In the case of the above example, the time threshold ts is set to a certain value between 160 μs and 500 μs. Whether the defective initial discharge or not is detected on the basis of whether the interception time is longer than the time threshold ts or not. In the case of non-discharge or oblique discharge, of course, it is not determined whether defective initial discharge occurs or not. In addition, in the case where a discharge is detected and the discharge is neither oblique discharge nor defective initial discharge, of course, the discharge is normal discharge.

Figure 9:
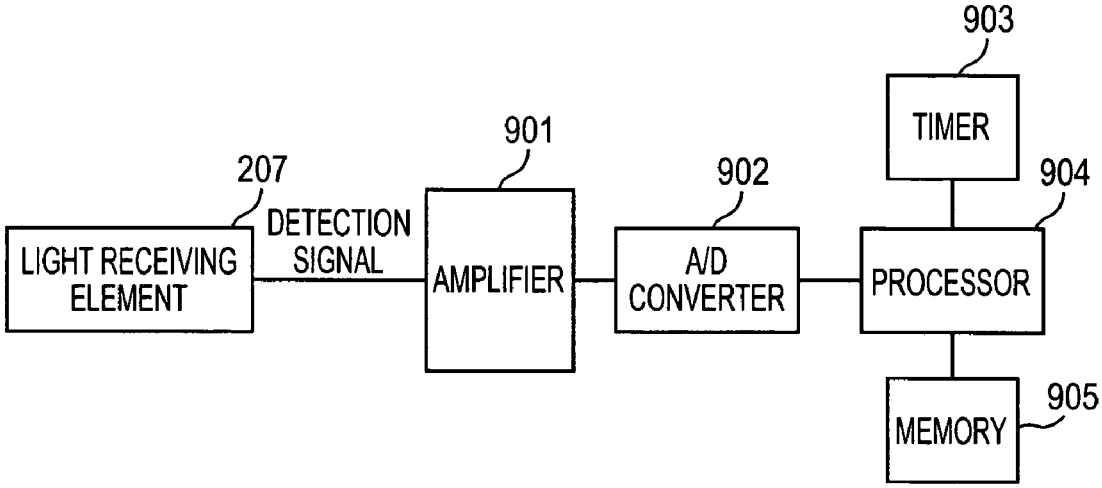
FIG. 9 is a block diagram showing the configuration for processing the detection signal output from the light-receiving element to check the condition of the nozzles in the printer of the embodiment.

FIG. 9 is a block diagram showing the configuration for processing the detection signal output from the light-receiving element 207 to check the condition of the nozzles in the printer of the present embodiment. In this configuration, the detection signal output from the light-receiving element 207 and showing the condition of each nozzle is amplified by an amplifier 901, and then the voltage of the detection signal is converted by an A/D converter 902 into a digital value. A processor (CPU) 904 controls the whole printer. Using a timer 903, during the first and second detection periods, the processor 904 reads the digital values of the voltage of the detection signal output from the A/D converter 902. The processor 904 compares the digital values with the voltage thresholds V1 and V2, respectively, so as to check whether discharge, non-discharge, or oblique discharge occurs. In addition, the processor 904 measures the interception time with the timer 903, and then compares the measured time value with the time threshold ts so as to check whether defective initial discharge occurs. A memory 905 includes a RAM and a ROM. In the case where non-discharge, oblique discharge, or defective initial discharge is detected, the data of the nozzle is stored in the RAM of the memory 905.

The detection time DT required to check all the nozzles of the recording head 108 is obtained with the following formula:

$$DT=(N/F)+TT$$

where N is the number of nozzles, F is discharge frequency, and TT is travel time of the recording head 108. The travel time TT is the sum of a first travel time and a second travel time. The first travel time is the time required to place the recording head 108 just above the nozzle checking unit 109 by moving the carriage 102. The second travel time is the time required to move the recording head 108 such that the four rows of nozzles 201 (see FIG. 5B) are placed just above the reflected light 204 and the direct light 205 one after another during the check. For example, when the number of nozzles is 5000, the discharge frequency is 10 kHz, and the travel time of the recording head is 2 sec, the detection time is about 2.5 sec. The detection time can be reduced by increasing the number of pairs of the light-emitting element 206 and the light-receiving element 207 or increasing the discharge frequency. However, increasing the number of pairs of the light-emitting element 206 and the light-receiving element 207 is disadvantageous in terms of cost and space.

After printing is stopped for a few minutes, defective discharge can occur due to adhesion of ink. Therefore, the checking of the operation of the nozzles is carried out when printing is stopped for a few minutes or more.

In the case where each nozzle discharges only once, the total amount of ink required for the check is the product of the number of nozzles and the amount of ink per discharge (per drop). For example, when the number of nozzles is 5000 and the amount of ink per discharge is 4 pl, the total amount of ink required for the check is 20 nl. This value is very small.

Figure 10:
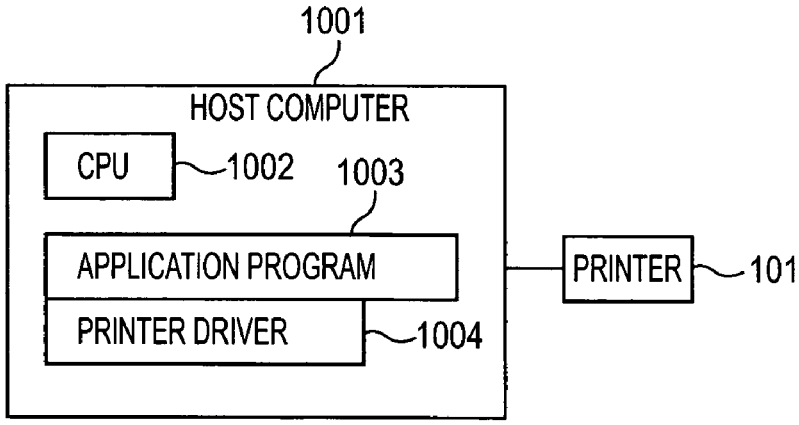
FIG. 10 is a block diagram schematically showing the configuration of a printer system composed of the printer of the embodiment and a host computer.

FIG. 10 is a block diagram showing the configuration of a printer system composed of the printer 101 and a host computer 1001. In FIG. 10, the host computer 1001 and the printer 101 are connected directly or via a LAN and so on. The host computer 1001 includes a CPU 1002. The CPU 1002 runs various application programs, an OS, and so on to control the operation of the host computer 1001. The host computer 1001 further includes a printer driver 1004 for controlling the printing operation of the printer 101. The printer driver 1004 receives printing data from the application programs 1003, converts the data into commands or data format that can be interpreted by the printer 101, and inputs the converted data into the printer 101 to make the printer 101 carry out printing.

As described above, the printer 101 checks each nozzle 201 of the recording head 108, and sends the check result to the printer driver 1004 of the host computer 1001. On the basis of the check result, the printer driver 1004 gives the user warning, if necessary.

Figure 11:
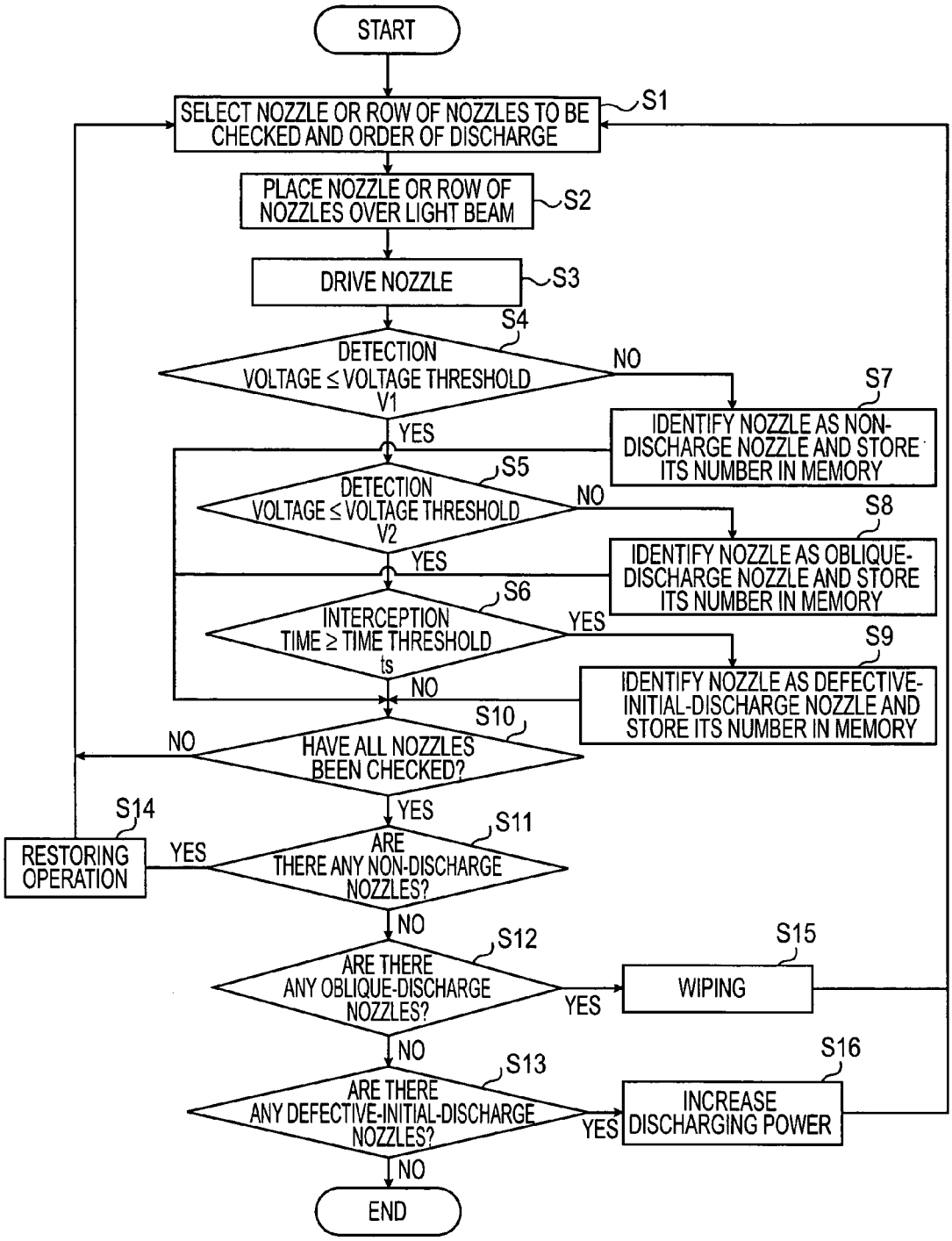
FIG. 11 is a flow chart showing the control procedure according to which the printer of the embodiment checks the nozzles.

FIG. 11 is a flow chart showing the control procedure according to which the printer 101 of the present embodiment checks the nozzles. A nozzle checking program corresponding to this control procedure is stored in the ROM of the memory 905 and run by the processor 904.

To check the nozzles, first, a nozzle or a row of nozzles to be checked and an order of discharge are selected (step S1). In the case where a row of nozzles is selected, the carriage 102 is moved so that the selected row of nozzles is placed just above the reflected light 204 and the direct light 205 of the nozzle checking unit 109 (step S2, see FIG. 5B).

Next, the selected nozzle is driven (step S3). During the first detection period, the voltage value of the detection signal is read from the A/D converter 902 and then compared with the first voltage threshold V1 (step S4). When the voltage value is higher than the first voltage threshold V1 throughout the first detection period, the nozzle is identified as a non-discharge nozzle, and the nozzle number is stored in the RAM of the memory 905 as a nozzle number of a non-discharge nozzle (step S7). Next, the procedure proceeds to step S10.

When the voltage value of the detection signal is lower than or equal to the first voltage threshold V1 during the first detection period, the nozzle is identified as a discharge nozzle. Next, during the second detection period, the voltage value of the detection signal is compared with the second voltage threshold V2 (step S5). When the voltage value is higher than the second voltage threshold V2 throughout the second detection period, the nozzle is identified as an oblique-discharge nozzle, and the nozzle number is stored in the memory 905 (step S8). Next, the procedure proceeds to step S10.

When the voltage value of the detection signal is lower than or equal to the second voltage threshold V2 during the second detection period, the interception time measured by the timer 903 is compared with the time threshold ts (step S6). When the interception time is longer than the time threshold ts, the nozzle is identified as a defective-initial-discharge nozzle, and the nozzle number is stored in the memory 905 (step S9). Next, the procedure proceeds to step S10.

When the interception time is shorter than the time threshold ts, the nozzle is identified as a normal-discharge nozzle, and the procedure proceeds to step S10. In step S10, it is determined whether all nozzles have been checked or not. When the check has not yet been completed, the procedure returns to step S1. By repeating steps S1 to S10, each nozzle in each nozzle row is checked.

When all nozzles have been checked, it is determined whether there are any non-discharge nozzles (step S11), whether there are any oblique-discharge nozzles (step S12), and whether there are any defective-initial-discharge nozzles (step S13), on the basis of the data stored in the memory 905 in steps S7, S8, and S9. If there are no defective nozzles, the procedure is ended. If there are any non-discharge nozzles, the purging unit 107 carries out an operation to purge the discharge ports (step S14). For example, the purging unit 107 sucks ink out of some nozzles including the non-discharge nozzles (normally out of all nozzles). If there are any oblique-discharge nozzles, a wiper 106 of the purging unit 107 wipes the ink-discharging surface of the recording head 108 (step S15). The wiper 106 wipes at least part of the ink-discharging surface including the discharging ports of the oblique-discharge nozzles (normally the entire surface). If there are any defective-initial-discharge nozzles, the discharging power of the nozzles is increased (step S16). That is to say, the voltage applied to heaters in the nozzles is increased, or the amount of time for which voltage is applied is increased.

After the maintenance step S14, S15, or S16, the procedure returns to step S1 and repeats the following steps to carry out the nozzle check again. If there are no defective nozzles, the procedure is ended. If any nozzle is still defective after the maintenance step S14, S15, or S16 is carried out twice, the nozzles are identified as completely defective nozzles, and the user is informed about it.

Instead of sucking ink out of the nozzles in step S14, the non-discharge nozzles may be driven several times to discharge ink (preliminary discharge). Alternatively, the discharging power may be increased, or other normal nozzles may compensate for the non-discharge nozzles (compensation). Instead of wiping to eliminate oblique discharge in step S15, discharge timing may be changed, or the compensation may be carried out. In step S16, the preliminary discharge may be carried out to eliminate defective initial discharge.

As described above, the present embodiment uses only a pair of elements (a light-emitting element 206 and a light-receiving element 207) and a reflector 210. On the basis of whether a discharged ink drop intercepts the reflected light 204 and the direct light 205 and on the basis of interception time (discharging velocity), the present embodiment can check whether each nozzle is a normal-discharge, non-discharge, oblique-discharge, or defective-initial-discharge nozzle. Since only one pair of elements (a light-emitting element 206 and a light-receiving element 207) is used, the checking system of the present embodiment is inexpensive and space-saving as compared with conventional systems.

Since the reflected light 204 is reflected by the reflector 210 provided on the ink-discharging surface of the recording head 108, the reflected light 204 travels close to the ink-discharging surface. Therefore, even when the deviation angle of oblique discharge is large, the ink drop intercepts the reflected light 204. Therefore, the checking system does not mistake the oblique discharge for non-discharge, and can detect the oblique discharge accurately.

The technique of the present invention can be used for checking the operation of the nozzles not only in Bubble-Jet®-type ink jet recording apparatuses but also in other types (e.g., piezo type) of ink jet recording apparatuses. In addition, the technique of the present invention can be used for checking the operation of the nozzles in not only ink jet recording apparatuses but also liquid discharging apparatuses that discharge liquid different from ink.

In the present embodiment, each nozzle discharges only once during the nozzle check. However, each nozzle may discharge a plurality of times in order to enlarge the waveform of the detection signal output from the light-receiving element 207.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-360656 filed Dec. 14, 2004, which is hereby incorporated by reference herein in its entirety.

What is claimed is:

1. An ink jet recording apparatus comprising:

a recording head comprising an ink-discharging surface and nozzles configured to discharge ink drops to record an image, the ink-discharging surface including ink-discharging ports of the nozzles in a length direction;

a light-emitting element and a light-receiving element disposed opposing each other in the length direction and substantially close to the ink-discharging surface, the light-receiving element being operable to output a detection signal;

a reflector provided on the ink-discharging surface and configured to reflect light emitted from the light-emitting element toward the light-receiving element, wherein the light-emitting element, the light-receiving element, and the reflector are disposed so that an ink drop normally discharged from one of the nozzles placed at a predetermined position intercepts light reflected by the reflector and then intercepts direct light transmitted from the light-emitting element to the light-receiving element, and the light-receiving element receives the light reflected by the reflector and the direct light transmitted from the light-emitting element and outputs the detection signal based on quantity of the received reflected and direct lights, wherein the ink jet recording apparatus drives the recording head to check whether the nozzle discharges an ink drop, and whether the ink drop is discharged in an appropriate direction, based on the detection signal of one ink drop discharged from the nozzle; and a timer measuring time from interception of the reflected light until interception of the direct light, wherein the ink jet recording apparatus checks whether the velocity of the ink drop is appropriate on the basis of the time measurement result of the timer.

2. A method for checking nozzles of an ink jet recording apparatus, the ink jet recording apparatus comprising:

a recording head comprising an ink-discharging surface and nozzles configured to discharge ink drops to record an image, the ink-discharging surface including ink-discharging ports of the nozzles in a length direction;

a light-emitting element and a light-receiving element disposed opposing each other in the length direction and substantially close to the ink-discharging surface, the light-receiving element being operable to output a detection signal; and a reflector provided on the ink-discharging surface and configured to reflect light emitted from the light-emitting element toward the light-receiving element, wherein the light-emitting element, the light-receiving element, and the reflector are disposed so that an ink drop normally discharged from one of the nozzles placed at a predetermined position intercepts light reflected by the reflector and then intercepts direct light transmitted from the light-emitting element to the light-receiving element, and the light-receiving element receives the light reflected by the reflector and the direct light transmitted from the light-emitting element and outputs the detection signal based on quantity of the received reflected and direct lights, the method comprising the steps of:

driving the nozzle;

checking whether the nozzle discharges an ink drop, and whether the ink drop is discharged in an appropriate direction, based on the detection signal of one ink drop discharged from the nozzle; and checking, in the case where the nozzle discharges the ink drop in an appropriate direction, whether the velocity of the ink drop is appropriate on the basis of time from interception of the reflected light until interception of the direct light.

3. A program for checking nozzles of an ink jet recording apparatus, the program being stored on a computer-readable medium and executable by a computer, the ink jet recording apparatus comprising:

a recording head comprising an ink-discharging surface and nozzles configured to discharge ink drops to record an image, the ink-discharging surface including ink-discharging ports of the nozzles in a length direction;

a light-emitting element and a light-receiving element disposed opposing each other in the length direction and substantially close to the ink-discharging surface, the light-receiving element being operable to output a detection signal; and a reflector provided on the ink-discharging surface and configured to reflect light emitted from the light-emitting element toward the light-receiving element, wherein the light-emitting element, the light-receiving element, and the reflector are disposed so that an ink drop normally discharged from one of the nozzles placed at a predetermined position intercepts light reflected by the reflector and then intercepts direct light transmitted from the light-emitting element to the light-receiving element, and the light-receiving element receives the light reflected by the reflector and the direct light transmitted from the light-emitting element and outputs the detection signal based on quantity of the received reflected and direct lights, the program comprising control procedures for performing the steps of:

driving the nozzle;

checking whether the nozzle discharges an ink drop, and whether the ink drop is discharged in an appropriate direction, based on the detection signal of one ink drop discharged from the nozzle; and checking, in the case where the nozzle discharges the ink drop in an appropriate direction, whether the velocity of the ink drop is appropriate on the basis of time from interception of the reflected light until interception of the direct light.

* * * * *